United States Patent [19]

Gegg

[11] 3,952,617

[45] Apr. 27, 1976

[54] WRENCH

[75] Inventor: Michael Joseph Gegg, Harahan, La.

[73] Assignee: Ray & Spielman, Baton Rouge, La.

[22] Filed: Mar. 19, 1975

[21] Appl. No.: 559,889

Related U.S. Application Data

[63] Continuation-in-part of Ser. No. 410,281, Oct. 26, 1973, abandoned.

[52] U.S. Cl. ..... 81/62; 192/43.1

[51] Int. Cl.[2] ..... B25B 13/46

[58] Field of Search ..... 81/58.1, 58.3, 61, 62, 81/63.1, 57.29; 192/48.92, 43.1

[56] References Cited

UNITED STATES PATENTS

| | | | |
|---|---|---|---|
| 858,894 | 7/1907 | Moss | 81/57.29 |
| 1,553,850 | 9/1925 | Davis | 192/48.92 |
| 2,701,490 | 2/1955 | Griparis | 81/57.29 |
| 2,703,030 | 3/1955 | Marvin | 81/57.29 |
| 3,707,893 | 1/1973 | Hofman | 81/58.1 |

*Primary Examiner*—James L. Jones, Jr.
*Attorney, Agent, or Firm*—Edgar E. Spielman, Jr.; David L. Ray

[57] ABSTRACT

The present invention relates to a unique ratcheting wrench which features an internal assembly which permits two modes of ratcheting. One mode of ratcheting is the conventional ratcheting made wherein the wrench bar is swung back and forth in a plane substantially perpendicular to the center axis of the nut or bolt being tightened. The other mode of ratcheting made possible by the assembly is ratcheting by rotating the handle of the wrench in a plane perpendicular to the plane of rotation of the nut or bolt to be tightened.

5 Claims, 10 Drawing Figures

WRENCH

CROSS REFERENCE TO RELATED APPLICATIONS

This case is a continuation-in-part of my co-pending application, Ser. No. 410,281, filed Oct. 26, 1973, now abandoned.

BACKGROUND OF THE INVENTION

Considerable attention has been placed on the development of ratchet wrenches with a smaller head, capable of being used in close quarters. These conventional ratchet wrenches, while being acceptable, have two major drawbacks. One of the drawbacks is that considerable room is needed to swing the wrench bar back and forth to effect tightening. If the room available is small then tightening is difficult at best. The other problem is that the gears of conventional ratchet wrenches offer more resistance to turning than does the nut or bolt being tightened. When this occurs no ratchet action is possible as the nut or bolt turn and not the ratchet gears.

Therefore it is an object of this invention to provide a ratchet wrench which can effect tightening of a nut or bolt in spaces which are too small for the needed swing of a conventional ratchet wrench. It is a further object to provide a ratchet wrench which can be used to tighten nuts or bolts with a reversible ratcheting action even though the turning resistance of the nuts or bolts is less than the resistance of the nuts or bolts is less than the resistance offered by conventional ratchet wrenches. A still further object of this invention is to provide a ratchet wrench which will enable the user to achieve tightening of a nut or bolt by two different modes, which modes may be used at the same time if desired.

The Invention

This invention relates to a two-ended, elongated lever bar having at one end of said bar a socket holding means for holding a socket in engagement with said bar, said socket holding means being rotatable in a plane perpendicular to the long axis of said bar; force transference means engageable with said socket holding means; a shaft means cooperative with said force transference means and extending through said bar, said shaft means being rotatable within said bar and extending beyond the other end of said bar, and said shaft means being for application of force applied thereto said force transference means; a hollow handle which covers at least a portion of said shaft means extending beyond the other end of said bar, rotates about the long axis of said bar, has a first engagement means within its interior for engaging a handle rotation control means, said handle rotation control means being carried by a first carrier means; said first carrier means being rigidly attached to said other end of said bar and encasing at least a portion of shaft means which extends beyond the other end of said bar, said handle rotation control means being selectively positionable with respect to said first engagement means so as to render the handle only rotatable in the direction dictated by the selected position of said handle rotation means; and has a second engagement means within its interior for engaging a shaft rotation control means, said shaft rotation control means being carried by a second carrier means, said second carrier means being rigidly attached to said shaft means, and said shaft rotation control means being selectively positionable with respect to said second engagement means so that rotation of the handle in the direction dictated by the selected position of said shaft rotation control means results in rotation of said shaft means in the same direction; and selection means for selectively positioning said handle rotation control means and said shaft rotation control means.

These and other features of this invention contributing satisfaction in use and economy of manufacture will be more fully understood from the following description of a preferred embodiment of the invention when taken in connection with the accompanying drawings, wherein identical numerals refer to identical parts and in which.

Figure 1:
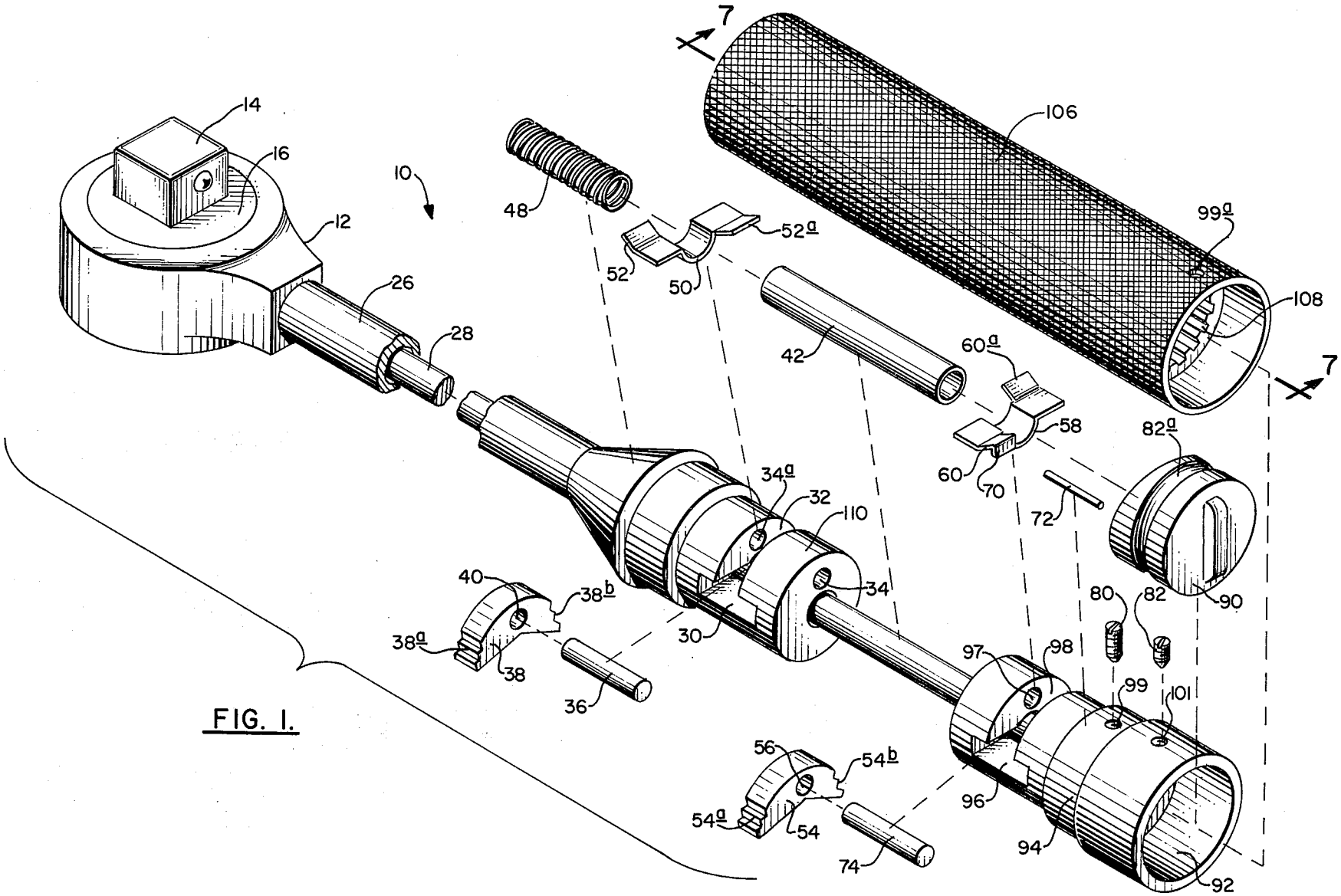
FIG. 1 is an enlarged partially broken away view of a wrench of this invention.

Referring now to the drawings, it can be seen that a ratchet wrench of this invention is a two-ended, elongated lever bar, generally designated by the numeral 10, having a conventional male attachment 14 for receiving a socket (not shown). Male attachment 14 is rigidly mounted to circular plate 16 which fits within gear housing 12. Connected to the bottom portion of plate 16 is master bevel gear 18 which is mounted on master bevel gear post 22. Master bevel gear post 22 is received into bottom plate 20 which is attached to gear housing 12 by means of screw **20*a*. Enmeshed with master bevel gear 18 is drive bevel gear 24 which is within gear housing 12. Attached to drive bevel gear 24 is drive shaft 28**.

As can be seen, drive shaft 28 is rotatably received within the center of bar 26, which is rigidly attached to gear housing 12. Bar 26 has an enlarged end 110 through which drive shaft 28 fits and which end carries a handle rotation control assembly.

Handle rotation control assembly includes front pawl pin 36 which fits into holes 34 and **34*a* in enlarged end 110. Front pawl pin 36 carries front pawl 38 by passage of front pawl pin 36 through front pawl aperture 40 in front pawl 38. Front pawl 38 has gear 38*a* and 38*b*. Fitting underneath front pawl 38 and front pawl pin 36 is front pawl rocker 50. The position of front pawl rocker 50 with respect to pawl 38 is shown in FIGS. 4–4B. Exerting pressure on front pawl rocker 50 away from male attachment 14 is spring 48. Spring 48 fits about drive shaft 28 inside of bar 26 as shown in FIG. 3**.

Figure 2:
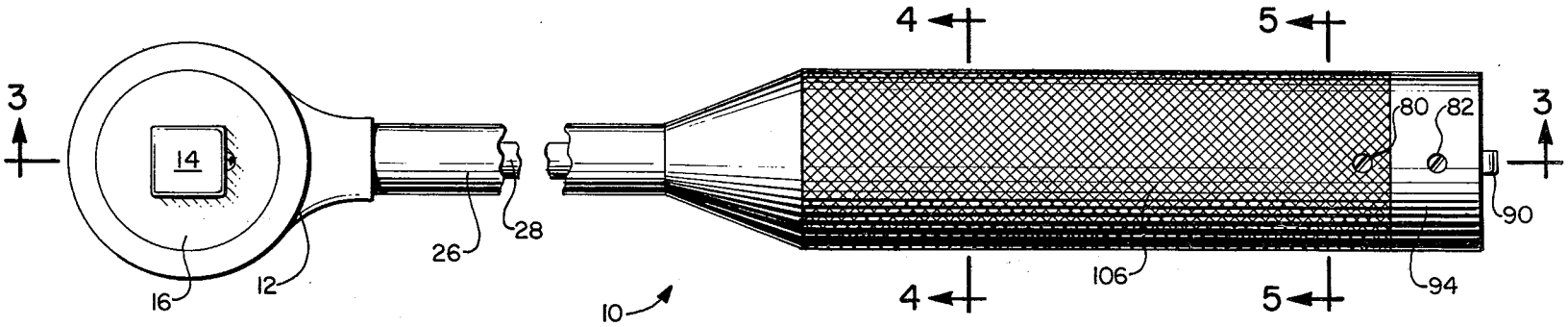
FIG. 2 is a top plan view, partially broken away, of the wrench shown in FIG. 1.
Figure 3:
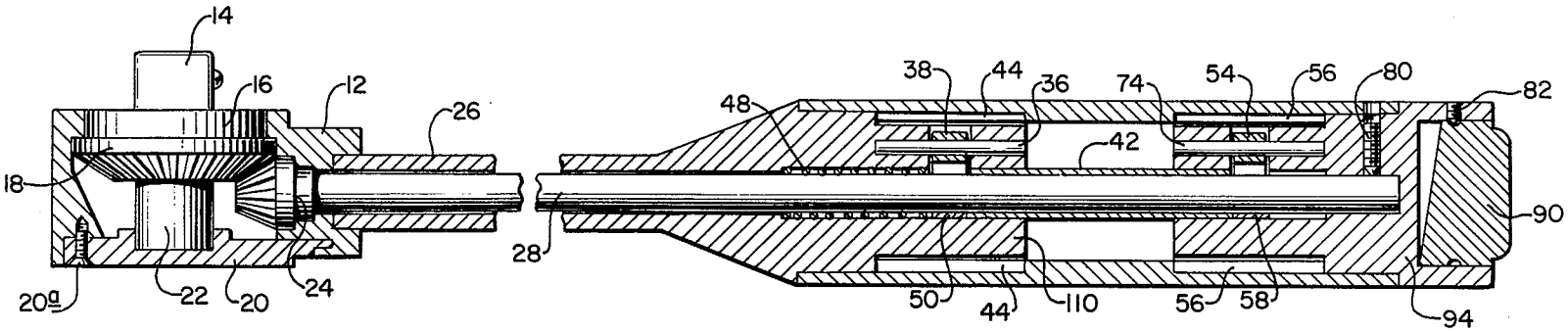
FIG. 3 is a sectional view taken along section lines 3—3 in FIG. 2.
Figure 4:
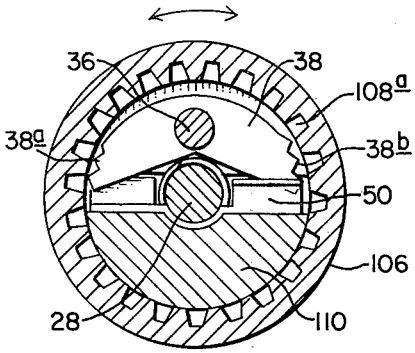
FIGS. 4, 4A and 4B are sectional views taken along section lines 4—4 in FIG. 2, showing different positions of the pawl.

As can be seen in FIGS. 1–3, drive shaft 28 extends beyond enlarged end 110. Positioned at the end of shaft 28, which end is opposite drive bevel gear 24, is the shaft rotation control assembly. The shaft rotation control assembly has carrier 94 which is rigidly fixed to drive shaft 28 by means of first set screw 80 which fits through front aperture 99.

Rear pawl 54 is carried by carrier 94 by means of rear pin 74 which fits into aperture 97 and another aperture concentric therewith (not shown) in carrier 94. Rear pin 74 also fits through rear pawl aperture 56 which has gears 54*a* and 54*b*.

Rear pawl rocker 58 fits underneath rear pawl 54 and under drive shaft 28. Rear pawl rocker 58 has face plate 70 which is engageable with selector rod 72 which is housed inside of carrier 94. Selector knob 90 fits within carrier 94 and is held in place by means of second set screw 82 which fits through second aperture 101. Set screw 82 fits within groove 82*a* on selector know 90 thereby allowing selector know 90 to be rotated a full 360°. As will be noted in FIGS. 1 and 3, selector knob 90 has a beveled surface whereby selector rod 72 can be selectively engaged by selector knob 90 thereby pushing selector rod 72 in engagement with face plate 70.

To communicate force applied on selector rod 72 by selector knob 90 to front pawl rocker 50 there is provided sleeve 42 which fits around drive shaft 28. Spring pressure from spring 48 will cause both rockers to move towards knob 90 when knob 90 is not engaging selector rod 72.

Figure 7:
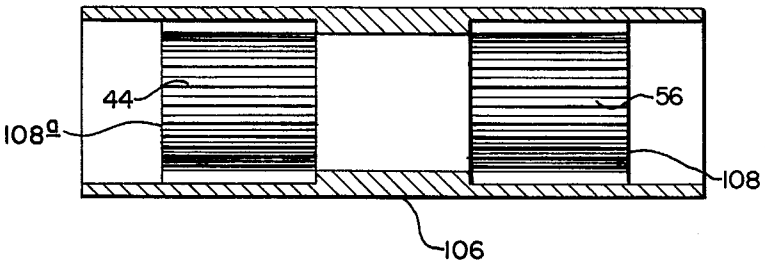
FIG. 7 is a sectional view taken along section lines 7—7 in FIG. 1.
Figure 5:
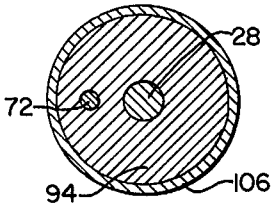
FIG. 5 is a sectional view taken along section lines 5—5 in FIG. 2.

Handle 106 fits over enlarged end 110 and carrier 94 and is held in rigid engagement with carrier 94 by means of second set screw 82 which passes through handle aperture 99*a*. Ring gears 108 and 108*a* are provided in handle 106, as is seen in FIG. 7. Ring gear 108*a* is engageable with front pawl 38 while ring gear 108 is engageable with rear pawl 54.

Figure 4A:
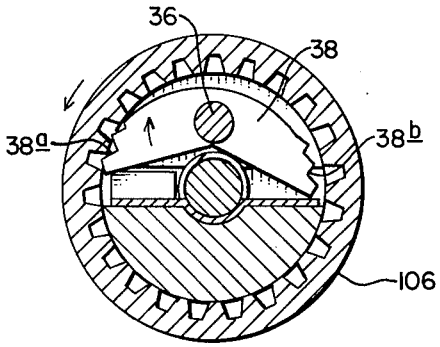
Figure 4B:
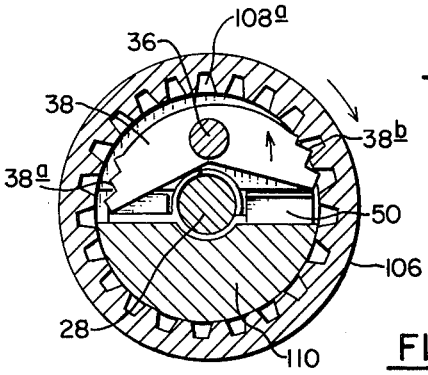

As can be seen in FIG. 1, enlarged end 110 has cut therein a horizontal space 30 and a vertical space 32. Horizontal space 30 is cut all the way through enlarged end 110 and is dimensioned so that front pawl rocker 50 is free to slide back and forth therein and so that wedge surfaces 52 and 52*a* will fit underneath ledges 30*a* and 30*b*. Vertical space 32 is dimensioned so as to receive front pawl 38. As can be appreciated from the drawings, front pawl rocker 50 has wedging surfaces 52 and 52*a*. As front pawl rocker 50 moves forward, i.e., towards male attachment 14, within horizontal space 30, it can be seen that wedge surface 52*a* will be exposed by vertical space 32 and that wedge surface 52 will be in position under ledge 30*a*. As shown in FIG. 4B, in this position front pawl rocker 50 will, by way of wedge surface 52*a*, cause pawl 38 to rock thus exposing gears 38*b* and concealing gears 38*a* to engaging ring gear 108*a* in handle 106. Should front pawl rocker 50 be moved rearwardly, i.e., away from male attachment 14, then wedge surface 52, as seen in FIG. 4A, would wedge up pawl 38 in the opposite direction causing pawl gears 38*a* to be exposed and pawl gears 38*b* to be concealed. FIG. 4 shows the position of the pawl and pawl rocker in the transition position between rearward and forward position. Likewise, there is a horizontal space 96 cut into carrier 94 and a vertical space 98 also cut into carrier 94. Horizontal space 96 is utilized to accommodate pawl rocker 58 in the same manner as horizontal space 30. Vertical space 98 is utilized to accommodate rear pawl 54. Pawl rocker 58 has wedging surface 60 and 60*a*. Depending from wedge surface 60 is before-mentioned face plate 70. Wedging surfaces 60 and 60*a* are directed in a direction opposite that of wedging surfaces 52 and 52*a* respectively. As can be appreciated from the drawings, forward movement of pawl rocker 58 will bring wedging surface 60 into contact with rear pawl 54 causing it to move about rear pawl pin 74 thus exposing pawl gear 54*a* and concealing pawl gear 54*b* with respect to ring gear 108. Movement to the rear of rear pawl rocker 58 will bring wedge surface 60*a* into play thus causing rear pawl 56 to rotate exposing pawl gears 54*b* and hiding pawl gears 54*a*.

Figure 6:
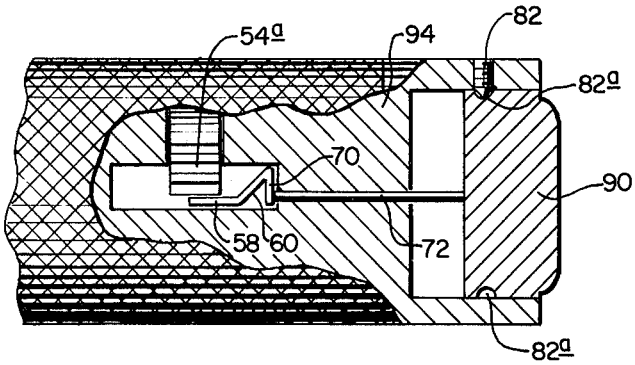
FIG. 6 is an enlarged view, partially broken away, of the rear portion of the wrench shown in FIG. 2.
Figure 6A:
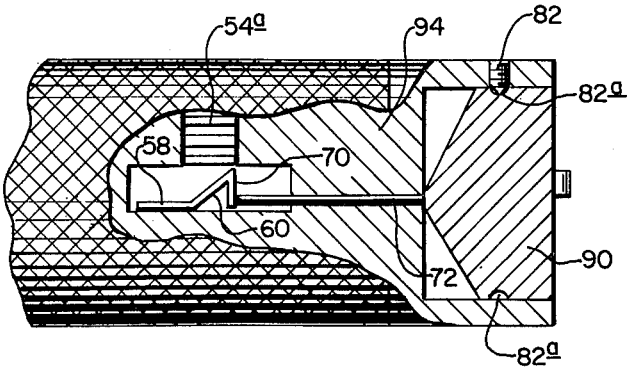

Forward and rearward motion of pawl rockers 50 and 58 is achieved by utilization of the before-mentioned beveled edge of selector knob 90 as it acts to push selector pin 72 forward to engage face plate 70. As seen in FIG. 6A, when face plate 70 is engaged, rear pawl rocker 58 is pushed forward which pushes sleeve 42 also forward. Since sleeve 42 abuts forward pawl rocker 50, pawl rocker 50 is also pushed forward which in turn compresses spring 48. When selector rod 72 is not pushed forward by the beveled surface of selector knob 90, as shown in FIG. 6, spring 48 will exert rearward pressure on the front pawl rocker 50, sleeve 42 and rear pawl rocker 59 and selector rod 72 to push them to the rear.

As mentioned previously, the apparatus of this invention is capable of tightening or loosening a nut or bolt with ratchet action in two different modes. The first mode resembles conventional ratcheting motion, i.e., the lever arm is swung back and forth in a plane substantially perpendicular to the center axis of the nut or bolt to be tightened. Assuming that the user of the apparatus of this invention would wish to tighten a nut or bolt in this mode, he would first turn selector knob 90 so that the high point of the beveled surface will engage selector knob 72 pushing rear pawl rocker 58 and front pawl rocker 50 into the forward position. This would expose front pawl 38 to wedge surface 52*a* thus causing front pawl gear 38*b* to come into engagement with ring gear 108*a*. Rear pawl rocker 58 will also be in the forward position thus exposing rear pawl 54 to the action of wedging surface 60 thus bringing rear pawl gear 54*a* into engagement with ring gear 108 in handle 106. With the gears thus engaged it can be seen that drive shaft 28 will be locked and not permitted to rotate as drive shaft 28 is attached to carrier 94 which is locked to handle 106 by the engagement of rear pawl gear 54*a* and ring gear 108. Keeping handle 106 from rotating is accomplished by engagement of pawl gear 38*b* and ring gear 108*a*. Since drive shaft 28 is not allowed to turn, drive bevel gear 24 will likewise not turn thus causing master bevel gear 18 to turn with bar 26 when handle 106 is swung to the right in the prior-described plane when the wrench is viewed in the position shown in FIG. 1. When the handle is brought back to the right a ratcheting action will occur as pawl gear 54*a* and 38*b* are not intermeshing with ring gears 108 and 108*a* respectively. Should loosening of the nut or bolt be desired then selector know 90 will be turned so that it is not in engagement with selector rod 72. In this position, spring 48 would push front pawl rocker 50 and rear pawl rocker 58 to the rear whereby front pawl 38 will be rocked so that front pawl gear 38*a* is in engagement with ring gear 108*a* and whereby rear pawl 54 will be rocked so that pawl gear 54*b* will be in engagement with ring gear 108. In this position the shaft is not allowed to rotate in the direction opposite that for tightening and thus loosening of the nut or bolt occurs. In both instances, when the ratcheting portion of the sequence occurs, drive shaft 28 is allowed to rotate so that drive bevel gear 24 will walk around master bevel gear 18 without imparting any force to the nut or bolt.

In the second mode, the apparatus of this invention is utilized to tighten or loosen nuts or bolts by rotation of handle 106 without swinging of the lever bar back and forth as is done in conventional ratcheting. To tighten a nut or bolt selector knob 90 is positioned so as to engage selector rod 72 pushing both pawl rockers in the forward position. This will engage pawl gears 54*a* and 38*b* with ring gears 108 and 108*a* respectively. As the handle is turned in a clockwise direction, carrier 94 will be likewise turned as pawl gear 54*a* will engage ring gear 108. Since carrier 94 is fixedly attached to shaft 28, shaft 28 will turn thus imparting the same rotational movement to master bevel gear 18. To loosen a nut and bolt, selector knob 90 is turned so as to disengage selector rod 72 thus placing both pawl rockers in the rearward position whereby pawl gears 54*b* and 38*a* engage ring gears 108 and 108*a* respectively. Turning of the handle in a counter-clockwise position will cause rod 28 to turn in a counter-clockwise position thus causing master bevel gear to rotate in a counter-clockwise position thus loosening the nut or bolt to be loosened.

Another feature of the apparatus of this invention is that both modes may be used simultaneously, i.e., the conventional swinging motion described above can occur at the same time that the handle rotation mode is utilized. This will result in a faster rate of rotation for master bevel gear 18 which results in a faster rate of tightening or loosening.

What I claim is:

1. A two-ended, elongated lever bar having:

a. at one end of said bar a socket holding means for holding a socket in engagement with said bar, said socket holding means being rotatable in a plane perpendicular to the long axis of said bar;

b. force transference means engageable with said socket holding means;

c. a shaft means cooperative with said force transference means and extending through said bar, said shaft means being rotatable within said bar and extending beyond the other end of said bar, and said shaft means being for application of force applied thereto to said force transference means;

d. a hollow handle which, i. covers at least a portion of said shaft means extending beyond the other end of said bar;

ii. is rotatable about the long axis of said bar;

iii. has a first engagement means within its interior for engaging a handle rotation control means, said handle rotation control means being carried by a first carrier means, said first carrier means being rigidly attached to said other end of said bar and encasing at least a portion of shaft means which extends beyond the other end of said bar, said handle rotation control means being selectively positionable with respect to said first engagement means so as to render the handle only rotatable in the direction dictated by the selected position of said handle rotation means, and iv. has a second engagement means within its interior for engaging a shaft rotation control means, said shaft rotation control means being carried by a second carrier means, said second carrier means being rigidly attached to said shaft means, and said shaft rotation control means being selectively positionable with respect to said second engagement means so that rotation of the handle in the direction dictated by the selected position of said shaft rotation control means results in rotation of said shaft means in the same direction; and e. selection means for selectively positioning said handle rotation control means and said shaft rotation control means.

2. The lever bar of claim 1 wherein said force transference means comprises a first beveled gear rigidly connected to said socket holding means and a second beveled gear connected to said shaft means, said beveled gears meshing one with the other.

3. The lever bar of claim 1 wherein said first engagement means and said second engagement means are ring gears coaxially mounted within said handle.

4. The lever bar of claim 1 wherein the handle rotation control means is a first pawl pivotally mounted to said first carrier means, said first pawl being arcuately movable about said pivot point and said shaft rotation control means is a second pawl pivotally mounted to said second carrier means, said second pawl being arcuately movable about said pivot point.

5. The lever bar of claim 4 wherein said selection means comprises longitudinally movable first and second pawl rocker means for causing said first and second pawls respectively to pivot about their pivot point causing one side of each pawl to be in an upward position thereby engaging said first and second engagement means respectively, and moving means for longitudinally moving said first and second pawl rocker means.

* * * * *